United States Patent [19]

Auberger

[11] 4,330,971

[45] May 25, 1982

[54] WALL FRAMING BRACKET

[76] Inventor: Earl J. Auberger, 10426 Lochcrest Dr., Cincinnati, Ohio 45231

[21] Appl. No.: 175,284

[22] Filed: Aug. 4, 1980

[51] Int. Cl.[3] ..... E06B 1/02

[52] U.S. Cl. ..... 52/210; 52/712; 403/232.1; 403/233

[58] Field of Search ..... 403/233, 262, 232.1, 403/231; 52/712, 715, 210, 213

[56] References Cited

U.S. PATENT DOCUMENTS

| | | | |
|---|---|---|---|
| 1,019,778 | 3/1912 | Fredrickson | 403/232.1 |
| 3,188,692 | 6/1965 | Earhart | 52/712 |
| 3,188,696 | 6/1965 | Earhart | 52/241 |
| 3,601,428 | 8/1971 | Gilb | 403/232.1 |
| 4,241,557 | 12/1980 | Jensen | 52/DIG. 6 |

FOREIGN PATENT DOCUMENTS

| | | | |
|---|---|---|---|
| 862969 | 2/1971 | Canada | 403/232.1 |

*Primary Examiner*—John E. Murtagh
*Attorney, Agent, or Firm*—Wood, Herron & Evans

[57] ABSTRACT

A wall framing bracket for retaining alignment of a floor plate and framing stud of a stud wall at the floor level of a passageway through that stud wall. The framing bracket is of generally U-shaped configuration, the bracket's longitudinal axis being aligned with a floor plate's longitudinal axis to embrace the floor plate and a framing stud during use. The bracket is connected directly to the floor by flanges that flare outwardly from the bracket's bottom edge.

7 Claims, 4 Drawing Figures

WALL FRAMING BRACKET

This invention relates to construction brackets. More particularly, this invention relates to wall framing brackets.

In the erection of buildings, the interior area of a floor space is often subdivided by the use of partition or stud walls. And with such partition walls it is necessary to provide passageways, e.g., doorways or archways, between rooms defined by those walls. This, of course, requires that the stud wall be provided with suitable framing in the location where the passageway is desired.

An interior partition or stud wall is basically comprised of a floor plate nailed directly to the floor, and a series of wall studs extending upwardly therefrom. Framing studs on opposite sides of a passageway are part of the stud wall and define a passageway. But there is no floor plate in the passageway framing area of the partition wall. Accordingly, when dry wall panels are nailed to the partition wall so formed, it is not unusual for the partition wall to move at the floor level, at the doorway or archway opening, a significant distance, e.g., $\frac{1}{4}$ inch to $\frac{3}{4}$ inch. This occurs because of the forces exerted on the wall's studs and floor plate in response to nailing of the dry wall panels thereto. In other words, the wall's floor plate is often knocked out of alignment at the passageway opening because of the nailing forces exerted against the partition wall's studs when dry wall panels are installed on, i.e., nailed to, those wall studs. This has the end result of providing doorways or archways which are not square. And this is not only cosmetically offensive to owners, but may interfere structurally with the efficient operation of a door's latch mechanism with the door frame's latch plate in the case of doorways.

Accordingly, it is the objective of this invention to provide a novel wall framing bracket that maintains alignment of a partition wall's floor plate and framing stud at a passageway through a partition wall.

In accord with this objective, the wall framing bracket of this invention is of generally U-shaped configuration, the bracket's longitudinal axis being aligned with a floor plate's longitudinal axis to embrace the floor plate and a framing's stud during use. The bracket is connected directly to the floor by flanges that flare outwardly from the bracket's side arms. This bracket, when installed, maintains alignment of a partition wall's floor plate and framing stud at a passageway through the partition wall.

The structure of this bracket, when installed, also permits longitudinal expansion/contraction of the framing stud when that stud is not fixed to the bracket by a fastener because the stud is trapped within the bracket.

Other objectives and advantages of this invention will be more apparent from the following detailed description taken in conjunction with the drawings in which.

Figure 3:
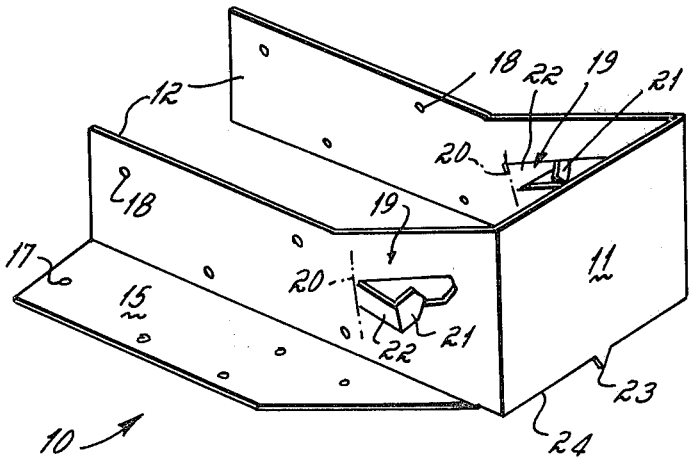
FIG. 3 is a view similar to FIG. 2 but illustrating only the wall framing brackets.

A wall framing bracket 10 in accord with the principles of this invention is illustrated in FIG. 3. As shown, the bracket 10 is of a generally U-shaped configuration, the bracket including a base 11 and side arms 12. The width W of the base 11 is not substantially greater than the width W′ of the framing studs 13 and floor plate 14 with which the bracket 10 is adapted for use. The height H of the base 11 is preferably greater than the thickness T of the floor plate 14 with which the bracket is adapted for use. And the length L of the bracket's two side arms 12 is at least twice the thickness T′ of the framing studs 13 with which the bracket 10 is adapted for use.

The bracket 10 also includes a foot flange 15 that extends outwardly from each side arm 12 to permit direct connection of the bracket with a sub-floor 16. Note particularly the bracket's foot flanges 15, and the bracket's side arms 12 are provided with holes 17, 18, respectively, through which the bracket 10 may be nailed to the sub-floor 16 and to the floor plate 14, respectively. The bracket 10 further includes an integrally-formed connector 19 in each of the side arms 12 adjacent the base 11. This connector 19 is in the nature of an ear punched out of the side arm and connected thereto on fold line 20. The ear 19 includes a tab 21 formed inwardly at right angles to the ear's leg 22, the ear being pivoted outwardly on the fold line 20 so that the tab 21 does not extend into the interior of the U-shaped bracket when the bracket is initially fabricated but not installed. The bracket 10 also includes a detent 23 that extends downwardly from the bottom edge 24 of the bracket's base 11.

Figure 1:
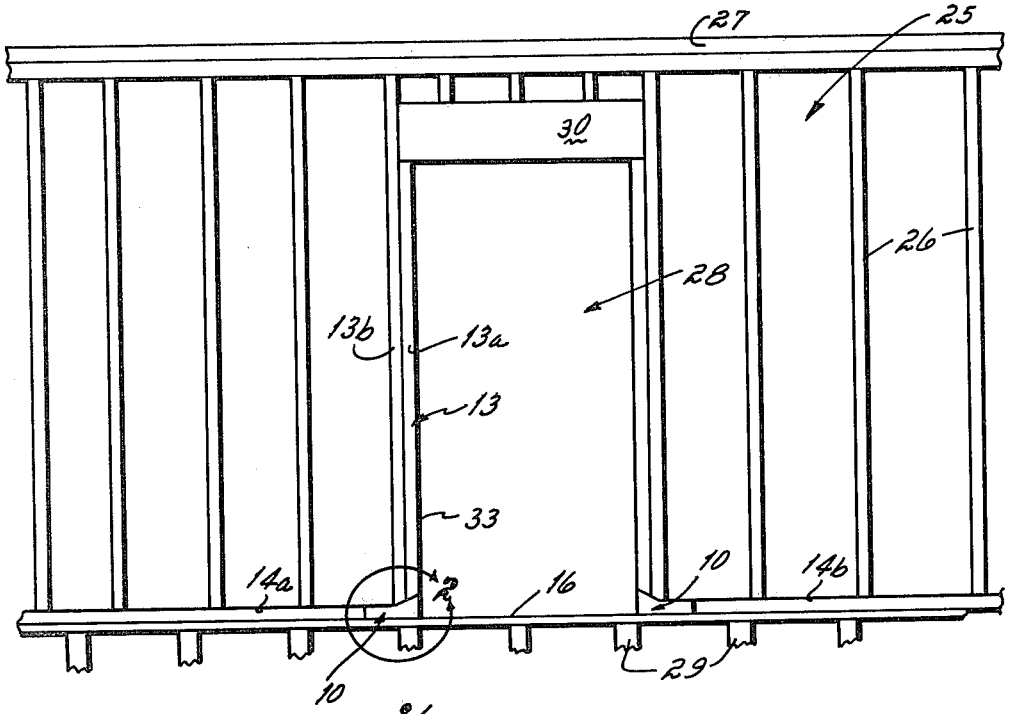
FIG. 1 illustrates use of a wall framing bracket in accord with the principles of this invention, the bracket being shown in installed position with a floor plate and framing studs of a partition wall.
Figure 2:
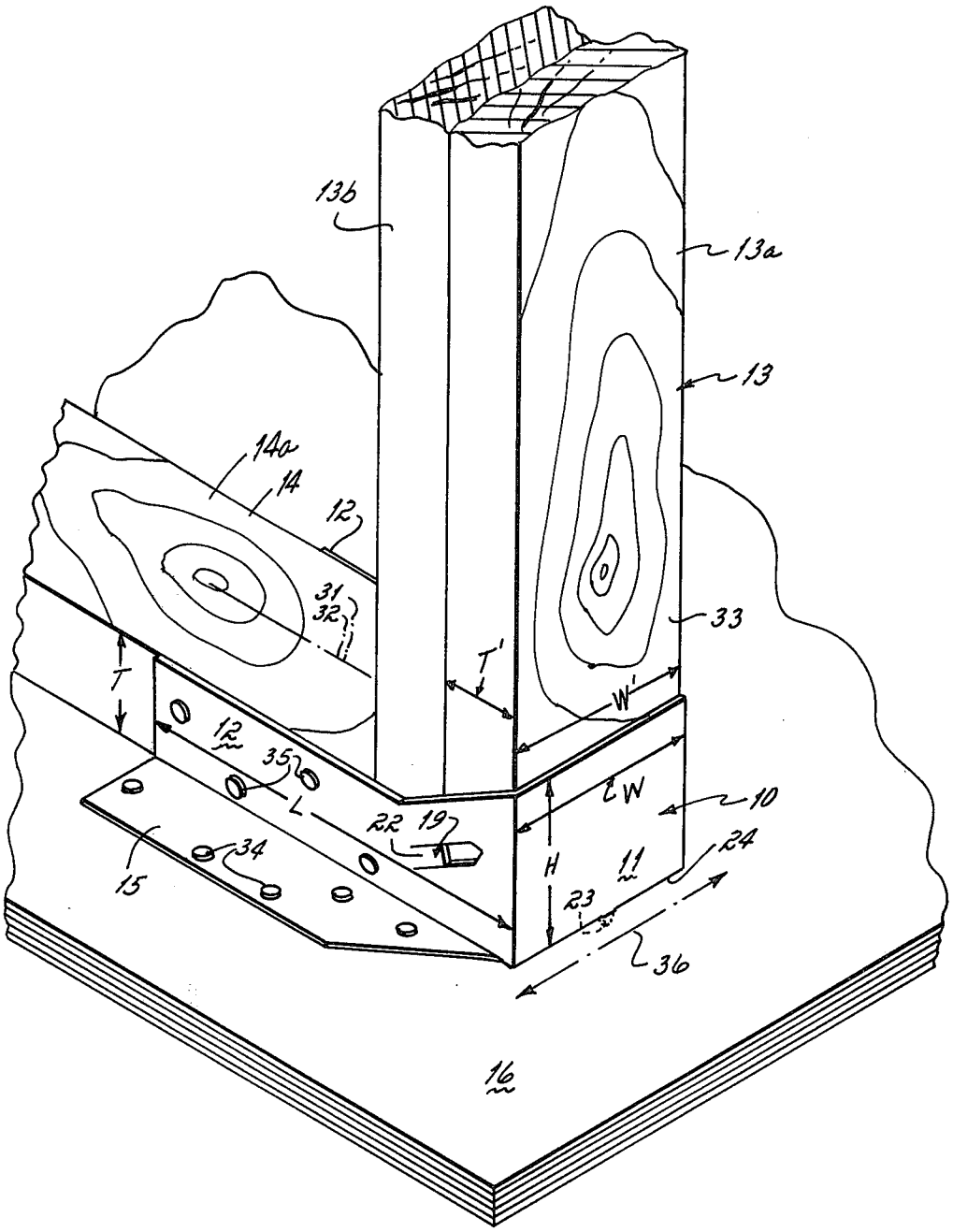
FIG. 2 is an enlarged and perspective view of the wall framing bracket illustrated in the encircled area of FIG. 1.

Use of the wall framing bracket 10 of this invention is particularly illustrated in FIGS. 1 and 2. As shown in FIG. 1, the bracket 10 is adapted for use with an interior partition or stud wall 25 comprised of wall studs 26, floor plate 14 and double ceiling plate 27. The stud wall's floor plate sections 14*a*, 14*b* on either side of passageway 28 are directly nailed to sub-floor 16, the sub-floor being supported by floor joists 29. The passageway's framing studs 13, on each side of the passageway 28, are double studs 13*a*, 13*b* such as might be used in framing a doorway. Alternatively, and not shown, an archway could be framed through the partition wall 25 by use of only a single framing stud. The inner door studs 13*a* support a header 30 at the top thereof to complete framing of the doorway 28. As shown in FIG. 1, a bracket 10 is used on each side of the passageway 28.

In use of the wall framing bracket 10, and as is particularly shown in FIG. 2, the framing bracket's center line 31 is aligned with the floor plate's center line 32 and is simply slid into engagement with the framing studs 13 until the bracket's base 11 is flush against the outer face 33 of the inner framing stud 13*a*. When this initial assembly position has been achieved, the bracket 10 can be lightly tapped on the foot flanges 15 so as to force the detent 23 into the plywood sub-floor 16 for preliminarily locating the bracket in final use position. Subsequently, nails 34 are used to firmly attach both the foot flanges 15 to the sub-floor. In this second intermediate installation position, therefore, the bracket 10 is firmly attached to the sub-floor 16, and the foot plate 14 and framing studs 13 adjacent the passageway 28 at the floor level cannot move since same are now tightly retained within the bracket. Thereafter, nails 35 can be used to complete the assembly ty connecting the bracket's side arms 12 to the floor plate 14, and to the outer framing stud 13*b*, and the bracket's connectors 19 may be used, if desired, to connect the bracket to the inner framing stud 13*a*. If the connectors 19 are not used, i.e., if the connectors are broken off the bracket, both the framing stud 13*a*, 13*b* will be free to expand or contract longitudinally within the bracket 10. It will be particularly noted that the framing studs 13 and the floor plate 14 are prevented from transverse motion (relative to the plane of the partition wall, and as indicated by phantom arrow 36) at floor level 16 when the bracket 10 is nailed to the floor plate and the framing studs, as well as when dry wall panels (not shown) are nailed to the partition wall studs 26, because of the firm pre-established innerconnection of the bracket's foot flanges 15 with the sub-floor 16. The wall framing bracket 10 of this invention, therefore, maintains the passageway 28 framing in alignment, i.e., in square, so that if the passageway is to be used as an archway it will not be cosmetically offensive, and if the passageway is to be used as a doorway there will be no hindrance to the efficient operation of a door's latch mechanism with the door frame's latch plate.

Figure 4:
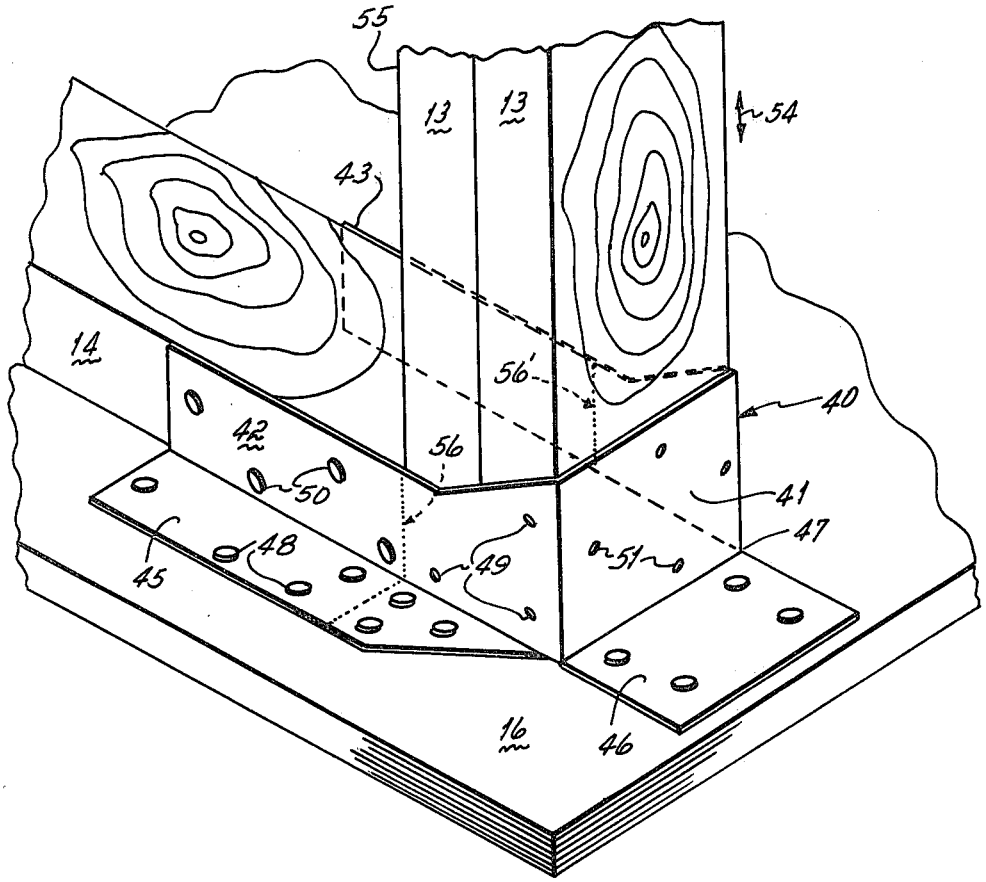
FIG. 4 is a perspective view similar to FIG. 2 but illustrating a second embodiment of the wall framing bracket.

Referring now to FIG. 4 there is illustrated a second embodiment of the framing bracket of this invention. In this embodiment, as in the embodiment of FIGS. 1–3, the bracket 40 is of a generally U-shaped configuration having a base 41 and side arms 42, 43. As in the embodiment of FIGS. 1–3 the width W of the base 41 is just slightly greater than the width W′ of the framing studs 13 and 14 with which the bracket is adapted to be used. And, as in the earlier embodiment, the height H of the base 41 is greater than the thickness T of the floor plate 14, and the side arms 42, 43 of the bracket are greater than twice the thickness T′ of the framing studs 13.

The bracket includes footrest flanges 45 which extend outwardly from each side arm 42, 43 to permit direct connection of the bracket with the sub-floor 16. Additionally, the bracket has a foot flange 46 which extends outwardly from the bottom edge 47 of the base 41. The foot flanges 45, 46 are provided with holes through which nails 48 may be driven for purposes of attaching the bracket to the sub-floor 16. Additionally, each of the arms 42, 43 has a plurality of holes 49 through which nails may be driven for purposes of attaching the bracket to the floor plate 14 and to the studs 13. The base 41 also has a plurality of holes 51 through which nails may be driven for purposes of securing the bracket to the studs 13.

As illustrated in FIG. 4, there are no nails within the holes 49, 51 of the bracket. Consequently, the studs 13 are unattached to the bracket although they are restrained against lateral movement within the bracket. Because they are unattached to the bracket 10, the studs are free for longitudinal movement in the direction indicated by the arrow 54. By leaving the studs free for this longitudinal movement, the studs may contract as they dry over a period of time without causing the door jamb formed by the studs from being skewed or distorted or without causing the bracket 40 to be pulled from the sub-floor 16.

In some applications it is desirable to place the studs 13 against a flat wall rather than within a wall as illustrated in FIG. 1. In that instance, the rear surface 55 of the inner stud 13 may rest against a flat surface. The bracket illustrated in FIG. 4 is particularly applicable to such an application. In that event the arms 42, 43 and flanges 45 are cut by conventional tin snips along the dotted lines 56, 56′. The effect of this cutting will be to make a shortened bracket of the bracket illustrated in FIG. 4, but the bracket may then be used in an application in which the rear stud 13 abuts against a wall or framing surface. The presence of the front flange 46 on the base 41 in such a shortened version of the bracket adds stability and prevents the bracket, even without the presence of the rear end of the arms 42 and flanges 45, from being pulled from the sub-floor.

While I have described only two embodiments of my invention, persons skilled in this art will appreciate various changes and modifications which may be made without departing from the spirit of my invention. Therefore, I do not intend for my invention to be limited except by the scope of the following appended claims.

I claim:

1. In combination, a building sub-floor, floor plates, and door framing studs defining a passageway through a partition wall, said door framing studs and floor plate being secured to said sub-floor by a wall framing bracket adapted to maintain alignment of said floor plate and door framing studs at floor level of said passageway, said bracket comprising two side arms aligned parallel one to the other and a base connected between said side arms, said side arms and base establishing a bracket of generally U-shaped configuration, and a foot flange attached to and extending outwardly from each of said side arms, said foot flanges being secured to said sub-floor and said U-shaped bracket embracing said floor plate and at least one of said door framing studs, and said bracket base being flush against said one of said door framing studs whereby said bracket serves to prevent transverse motion of said floor plate and framing stud relative to the plane of said partition wall.

2. The combination of claim 1 in which said bracket comprises plural holes in each of said foot flanges, and nails passing through said holes of said foot flanges into said subfloor for securing said bracket to said floor.

3. The combination of claim 1 said bracket comprising plural holes in each of said bracket side arms, and nails passing through said holes into at least one of said floor plate and said framing stud.

4. The combination of claim 1 said bracket comprising at least one fastener integrally formed with one of said bracket side arms, said fastener comprising a tab formed from said side arm and pivotable on a pivot axis defined at the connection of said tab with said side arm, said tab being pivoted on said axis into fastening relation with one of said floor plate and said framing stud.

5. The combination of claim 1 wherein the vertical height of said bracket base is substantially greater than the vertical thickness of said floor plate.

6. The combination of claim 1 wherein the horizontal length of said bracket side arms is substantially greater than the horizontal thickness of one said framing studs.

7. The combination of claim 1 said bracket further comprising a detent extending downwardly from the bottom edge of one of said bracket arms and said bracket base, said detent being embedded in said sub-floor to position said bracket in operational assembly with said floor plate and said framing stud prior to final attachment of said bracket to said floor.

* * * * *